US006212998B1

(12) United States Patent
Thompson et al.

(10) Patent No.: US 6,212,998 B1
(45) Date of Patent: Apr. 10, 2001

(54) PACKINGS ON PUMP ROD

(75) Inventors: David J. Thompson, Oak Grove; Thomas D. Lindblom, Rogers, both of MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 09/219,296

(22) Filed: Dec. 21, 1998

Related U.S. Application Data

(60) Provisional application No. 60/070,353, filed on Jan. 2, 1998.

(51) Int. Cl.[7] ..... F16J 15/18
(52) U.S. Cl. ..... 92/168; 92/251; 92/257
(58) Field of Search ..... 92/168, 252, 257, 92/251, 250

(56) References Cited

U.S. PATENT DOCUMENTS

| | | | | |
|---|---|---|---|---|
| 2,726,908 | * | 12/1955 | Nied | 92/168 |
| 3,046,621 | * | 7/1962 | Morton | 92/168 |
| 4,345,766 | | 8/1982 | Turanyi | 277/30 |
| 4,440,404 | | 4/1984 | Halliburton | 277/124 |
| 4,572,519 | | 2/1986 | Schlumberger | 277/124 |
| 4,875,690 | | 10/1989 | Maruyama | 277/12 |
| 4,878,815 | | 11/1989 | Stachowiak | 417/63 |
| 4,991,495 | | 2/1991 | Loegel et al. | 92/165 |
| 5,228,842 | | 7/1993 | Wagner | 417/360 |
| 5,740,718 | * | 4/1998 | Rathweg | 92/168 |

* cited by examiner

*Primary Examiner*—Edward K. Look
*Assistant Examiner*—Thomas E. Lazo
(74) *Attorney, Agent, or Firm*—Douglas B. Farrow

(57) ABSTRACT

A design for a packing assembly for a reciprocating piston pump is shown which allows for tighter tolerancing and increased packing life.

3 Claims, 3 Drawing Sheets

PACKINGS ON PUMP ROD

RELATED APPLICATIONS

This application is a continuation-in-part of U.S. Provisional Application No. 60/070,353, filed Jan. 2, 1998.

BACKGROUND OF THE INVENTION

Reciprocating piston pumps have been well known for many years for paint and other viscous materials. While current designs are generally satisfactory for their intended use, users are always desirous of increased packing life so as to prevent interruption of jobs and productivity.

SUMMARY OF THE INVENTION

It is therefore an object of this invention to provide a pump which is easily and inexpensively manufactured.

This invention serves to eliminate parts and assembly time, provide a nonadjustable packing cluster and with an increased stack height which provides more load carrying capabilities and running true to the cylinder which will result in an increase of as much as 50% over standard packing life and eliminate torque sensitive packing adjustments.

The pump rod is machined to allow relief with a shoulder that provides an area where the packings and glands slide on to the rod. This provides exact alignment and runout to the upper portion of the rod and to which throat packings and glands align as well. This allows for minimal side loading or twisting between the two sets of packings and glands. It also provides a one piece piston that can be screwed into the end of the rod to compress the packing cluster to a predetermined compression tolerance and eliminates multiple assembly pieces and torque settings for the packings.

An additional leather and UHMWPE packing are added to the piston to eliminate any rocking of the piston which causes gland wear against the cylinder which may lead to reduced life. Using the various features of the instant invention, a packing life increase of greater than 50% has been observed compared to current designs.

Piston life is increased by over 50% to the precise alignment of the rod and upper throat packings and glands and precise tolerancing. The packings are preloaded to a predetermined compression tolerance for ease of installation and maintenance. Current assemblies include a piston with a torque nut to assemble the head of the piston and a rod.

This leaves the runout tolerances to be determined by threads on the piston and piston head along with torque nuts and LOCTITE®. Such designs can result in premature piston failure.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
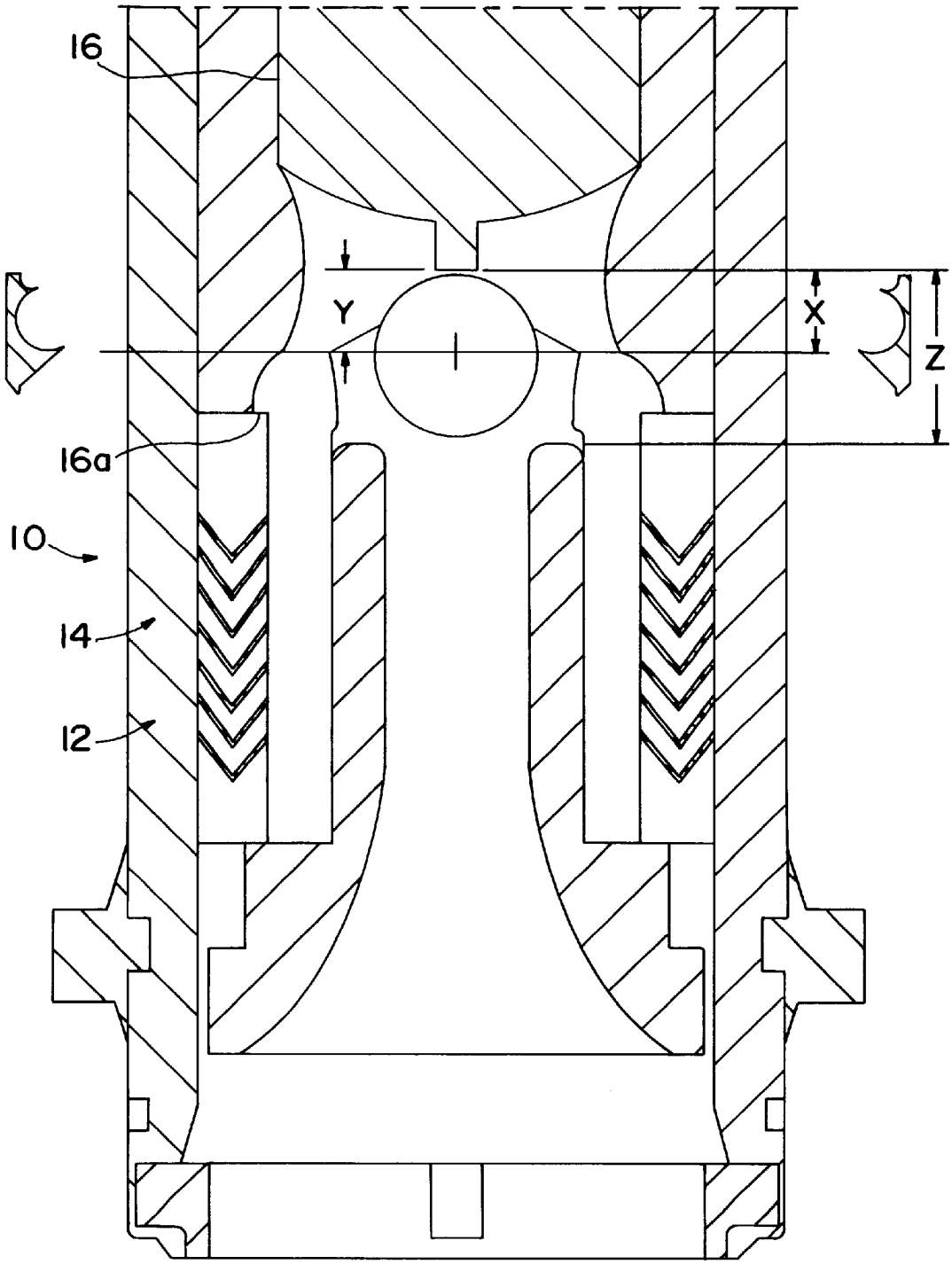
FIG. 1 is a cross-sectional view detailing the instant invention.
Figure 2:
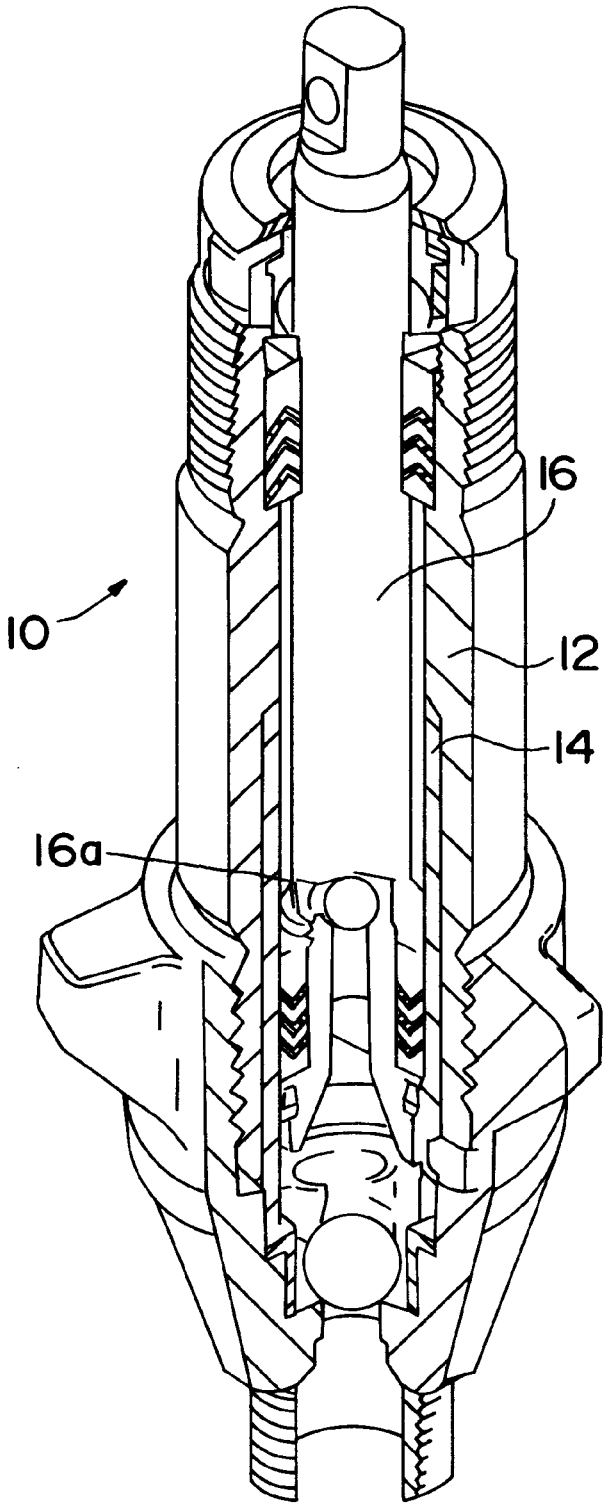
FIG. 2 is a cross-sectional view of the pump incorporating the instant invention.
Figure 3:
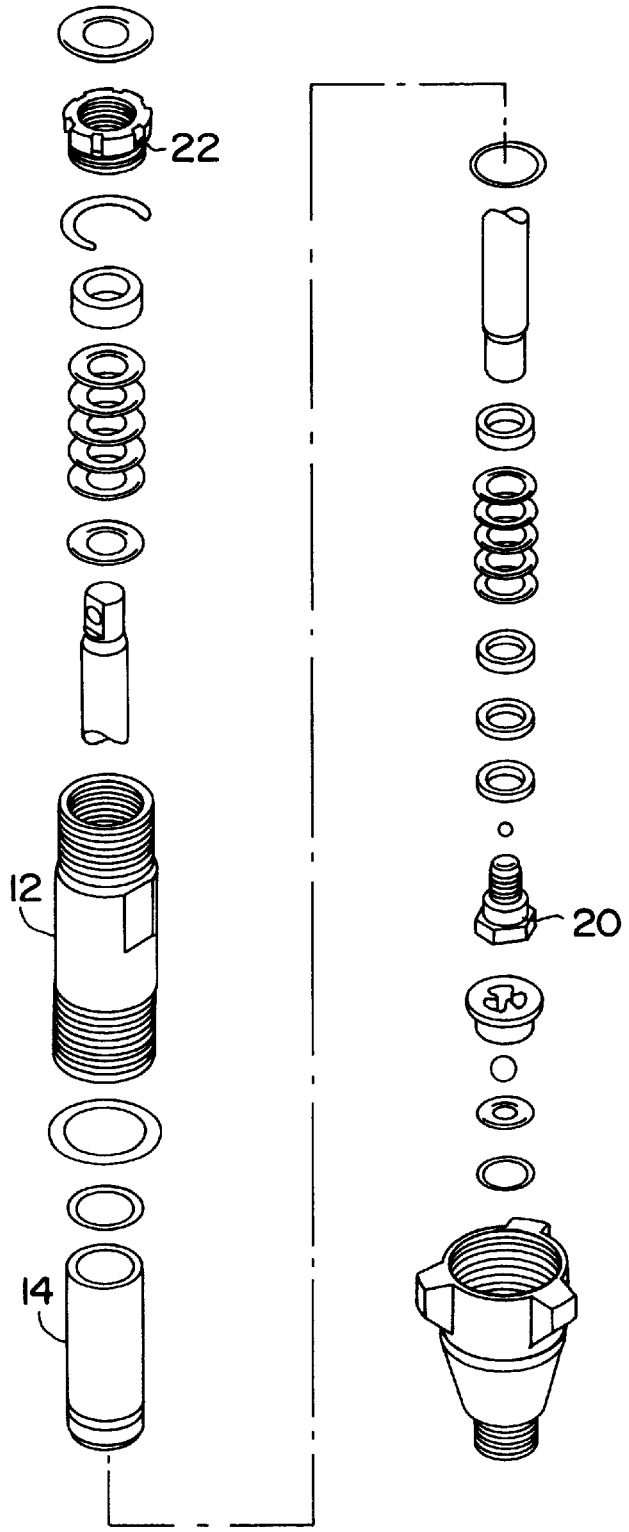
FIG. 3 is an exploded view of the pump incorporating the instant invention.

The instant invention generally designated 10 is comprised of a cylinder 12 having a sleeve 14 thereon, a piston rod 16 having a shoulder 16*a* and a packing gland 20 along with a throat packing gland 22.

It is contemplated that various changes and modifications may be made to the pump design without departing from the spirit and scope of the invention as defined by the following claims.

What is claimed is:

1. In a reciprocating piston pump having a piston rod having upper and lower ends and reciprocating within a cylinder and having packings sealing between said piston and said cylinder, the improvement comprising said rod having a relief along the circumference thereof, said packings being captured and located on said rod so as to move with said rod relative to said cylinder while reciprocating.

2. The reciprocating piston pump of claim 1 wherein said packings are located adjacent the lower end of said piston rod.

3. The reciprocating piston pump of claim 1 further comprising a set of throat packings between said cylinder and said rod adjacent said upper end.

* * * * *